United States Patent [19]

Petit

[11] Patent Number: 4,994,969

[45] Date of Patent: Feb. 19, 1991

[54] AUTOMATIC YARD OPERATION USING A FIXED BLOCK SYSTEM

[75] Inventor: William A. Petit, Spencerport, N.Y.

[73] Assignee: General Signal Corporation, Stamford, Conn.

[21] Appl. No.: 457,660

[22] Filed: Dec. 27, 1989

[51] Int. Cl.[5] ..... G06F 7/70; G06F 15/48; G06G 7/70; G06G 7/76

[52] U.S. Cl. ..... 364/424.01; 364/426.05; 364/436; 246/27; 246/182 AB

[58] Field of Search ..... 364/424.01, 424.02, 364/426.01, 426.05, 436; 246/3-7, 2 R, 20, 26, 27, 167, 167 A, 167 D, 167 M, 177, 182 A, 182 AA, 182 AB, 187 A

[56] References Cited

U.S. PATENT DOCUMENTS

| | | | |
|---|---|---|---|
| 2,948,234 | 8/1960 | Hughson | 246/2 R X |
| 4,023,753 | 5/1977 | Dobler | 246/5 |
| 4,166,599 | 9/1979 | Auer, Jr. et al. | 246/63 A |
| 4,244,672 | 1/1981 | Lund | 246/5 X |
| 4,641,243 | 2/1987 | Hartkopf et al. | 364/436 |
| 4,763,267 | 8/1988 | Knight et al. | 364/436 |
| 4,770,122 | 9/1988 | Ichihashi et al. | 246/182 AB X |

*Primary Examiner*—Parshotam S. Lall
*Assistant Examiner*—Ed Pipala
*Attorney, Agent, or Firm*—John F. Ohlandt

[57] ABSTRACT

A system for automatic operation of rapid transit vehicles in a railway yard. The vehicles have a receiver system which is responsive to information communicated thereto and a control system responsive to the receiver system for controlling the continued operation of vehicle. The invention includes: a first entry/exit track circuit having at least one transmitting system for transmitting vehicle control information to vehicles within its section of the first entry/exit track circuit, and at least one switching system for reversing the first entry/exit track circuit; a second entry/exit track circuit having at least one transmitting system for transmitting vehicle control information to vehicles within its section of the second entry/exit track circuit, and at least one switching system for reversing the second entry/exit track circuit.

6 Claims, 2 Drawing Sheets

AUTOMATIC YARD OPERATION USING A FIXED BLOCK SYSTEM

The present invention is directed to a system for automatic operation (driverless) of rapid transit vehicles within railway yard limits using a fixed block design. This system is designed primarily for the storage or parking of rapid transit vehicles, but may also be applied to car wash tracks, maintenance tracks, etc.

BACKGROUND OF THE INVENTION

Various systems have been designed to allow automatic (driverless) operation of rapid transit vehicles in mainline revenue service (i.e., passenger carrying operations) using a fixed block design.

In a fixed block design (as shown in FIG. 3 attached hereto) the guideway is divided into segments called blocks. Such a design can be appreciated from U.S. Pat. No. 4,166,599, assigned to the assignee of the present invention, the disclosure of which is incorporated herein by reference.

In the system briefly described in U.S. Pat. No. 4,166,599 as prior art, and illustrated here in FIG. 3, block boundaries are identified by short vertical strokes through the horizontal line identifying the guideway. The arrows indicate information transfer capability, and the shorthand "DP" refers to data processing.

An apparatus is arranged in each block, for detecting the presence of a vehicle in that block. This wayside apparatus may be coupled to wayside apparatus of one or more adjacent upstream blocks for the purpose of informing vehicles in such upstream blocks of the presence of a vehicle in a downstream block. In one specific application, for example, the block directly upstream of an occupied block is provided with a signal requiring an emergency stop. The next adjacent upstream block is provided with a signal requiring a stop, the next adjacent upstream block is provided with a signal calling for a low speed, and so on. In effect, an information communication arrangement is combined with distributed wayside data processing or computing. In such a system, the vehicle headway, i.e., the distance between moving vehicles, is at least one block long, and may, in normal practice, be two or more blocks long.

Another system is called the moving block design (as shown in FIG. 4 attached hereto), wherein each vehicle that is being controlled, transmits its location to a controlling authority, usually on a periodic basis. Thus, the controlling authority has available to it information as to the location and, perhaps speed, of all the vehicles being controlled. Under these circumstances, the controlling authority then provides signals to the vehicles, based upon downstream traffic conditions, allowing the vehicles to proceed at safe speeds, or on the other hand, requiring the vehicles to stop.

A third method for automatic (driverless) operation of rapid transit vehicles in mainline revenue service is set forth in the already cited U.S. Pat. No. 4,166,599. This patent discloses a control system in which each vehicle has provided to it information regarding the next adjacent downstream occupied or unavailable block; the system relies on distributed (i.e., vehicle carried) data processing or computing. This system avoids the need for multiple communication channels required by the moving block approach. At the same time, however, the single communication channel may provide to any vehicle the identity of the block it occupies, the identity of the next adjacent downstream occupied or unavailable block, and the speed of the vehicle in such block. With this information, the upstream vehicle's headway can be reduced to approach the headway achievable in moving block systems.

The practice of automatic (driverless) operation of rapid transit vehicles has not been extended to yard operations. Current systems for parking and storing rapid transit vehicles in railway yards require a driver to move the vehicles through the yard and perform the parking, coupling and uncoupling maneuvers. The use of drivers for parking and storing of rapid transit vehicles is both costly and inefficient. It is, therefore, highly desirable to incorporate an automatic (driverless) operation in yard operations.

The present invention resides in a system in which the automatic operation is continued from the mainline revenue service to the railway yard for driverless parking and storage of rapid transit vehicles. The present invention provides the following advantages over conventional systems for parking rapid transit vehicles in a railway yard: (1) allows safe driverless operation within yard limits; (2) vehicles can be stored singly or in multiple vehicle consists which reduces the number of required coupling and uncoupling moves; (3) vehicles can be automatically coupled and uncoupled under control of a non-vital yard computer; (4) vehicles can be closely parked reducing required yard area; (5) allows use of profile stop command interlocked with adjacent storage tracks and entry/exit tracks (and time limited operation); (6) distributed system allows fallback operation in the event of a single component failure (as opposed to moving block system); and (7) allows use of same on board equipment as in revenue service.

Additional advantages of the present invention shall become apparent as described below.

SUMMARY OF THE INVENTION

A system for automatic operation of rapid transit vehicles in a railway yard. The vehicles have a receiver means which is responsive to information communicated thereto and a control means responsive to the receiver means for controlling the continued operation of said vehicle.

The system according to the present invention includes: a first entry/exit track circuit having at least one transmitting means for transmitting vehicle control information to vehicles within its section of the first entry/exit track circuit, and at least one switching means for reversing the first entry/exit track circuit; a second entry/exit track circuit having at least one transmitting means for transmitting vehicle control information to vehicles within its section of the second entry/exit track circuit, and at least one switching means for reversing the second entry/exit track circuit; at least one storage track disposed between the first entry/exit track circuit and the second entry/exit track circuit, and having at least one storage track circuit, each storage track circuit having at least one transmitting means for transmitting vehicle control information to vehicles within the storage track circuit; and a computer capable of sending commands to each transmitting means to allow the vehicles to operate. The computer is used to send non-vital requests to the interlocking logic which converts the non- vital requests to vital cab signal requests and issues the vital cab signal requests to each transmitting means and switching means.

The transmitting means is typically a cab signal loop which injects an audio frequency cab signal into its associated track circuit, whereby the cab signal is received by a receiver means on board the vehicle and is translated into commands by a control means to allow the vehicle to operate.

It is an additional object of the present invention that each storage track circuit and entry/exit track circuit include a second transmitting means to allow bi-directional movement of the vehicles.

A further object of the present invention is to provide a method for automatic operation of rapid transit vehicles in a railway yard. The railway yard comprises a first entry/exit track circuit, a second entry/exit track circuit, and at least one storage track disposed between the first entry/exit track circuit and the second entry/exit track circuit, and having at least one storage track circuit.

This method comprises the following steps: signaling a switch means disposed on the first entry/exit track circuit until the first entry/exit track circuit is occupied by a vehicle; signaling a transmitting means on the first entry/exit track circuit to allow the vehicle to proceed until the storage track circuit is occupied; and signaling a transmitting means on the storage track circuit to issue a command to park the vehicle.

The present invention may also include many additional features which shall be further described below.

DESCRIPTION OF THE PREFERRED EMBODIMENTS

The present invention is directed to a system for automatic operation (driverless) of rapid transit vehicles within railway yard limits using a fixed block design. This system is designed primarily for the storage or parking of rapid transit vehicles, but may also be applied to car wash tracks, maintenance tracks, etc.

Figure 1:
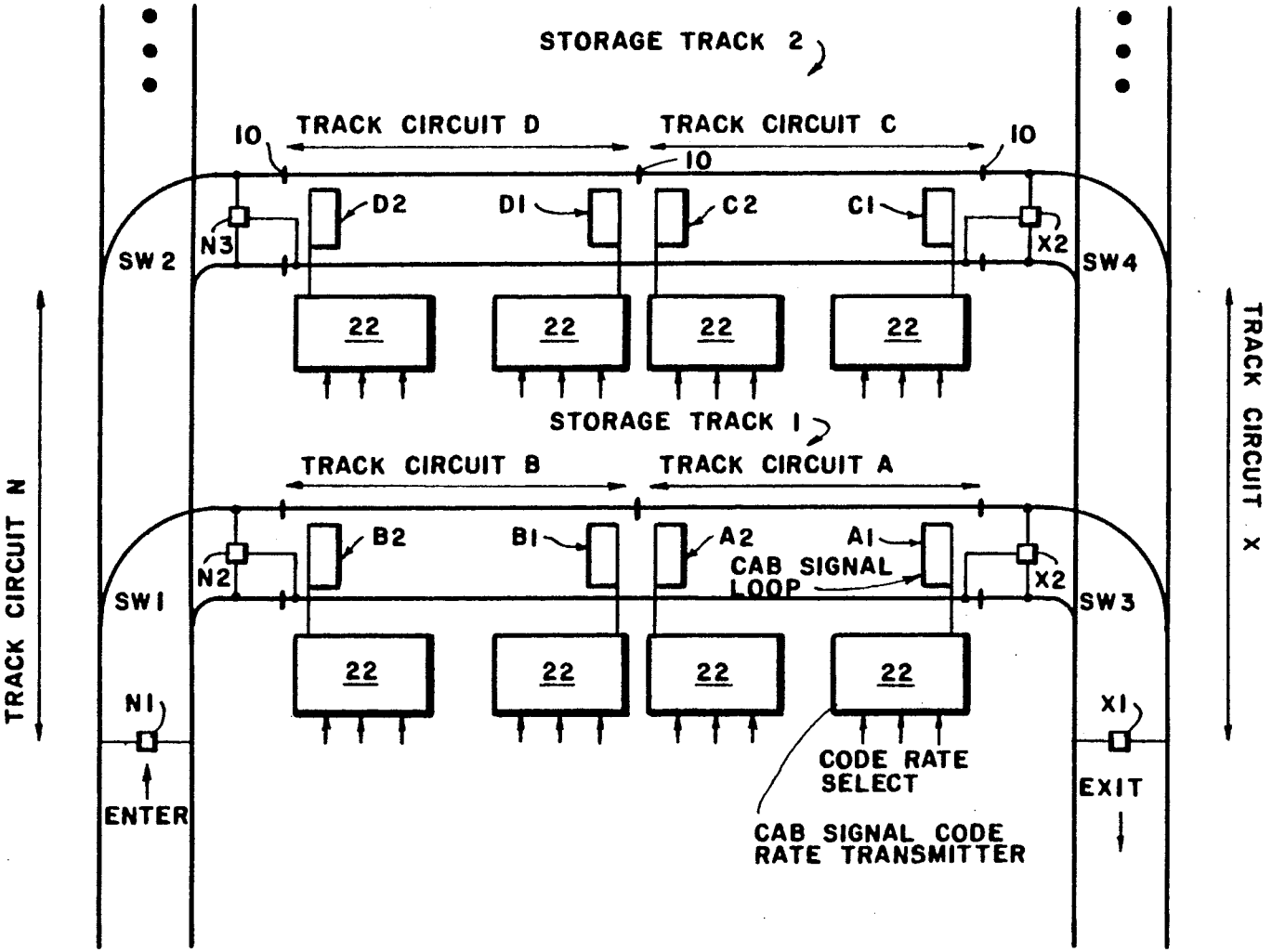
FIG. 1 is a schematic representation of a railway yard having a fixed block design in accordance with the present invention.
Figure 2:
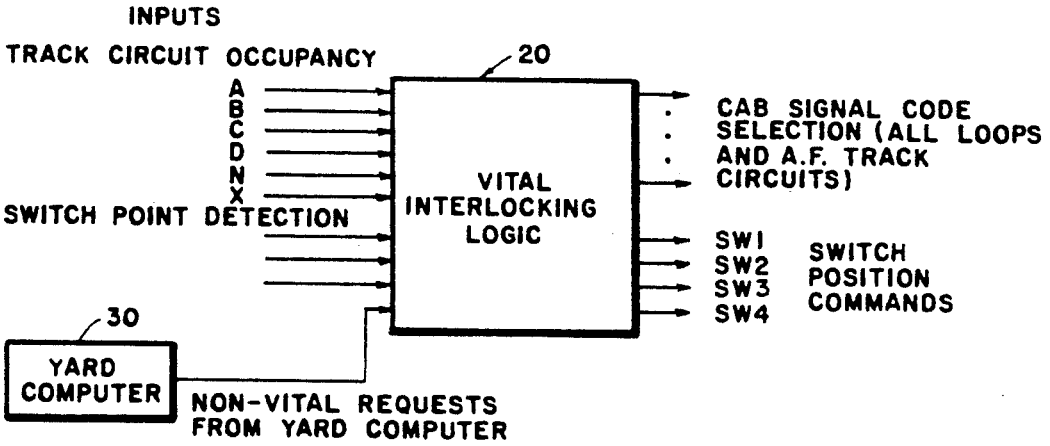
FIG. 2 is a schematic diagram of the computer and interlocking logic used in accordance with the present invention.
Figure 3:
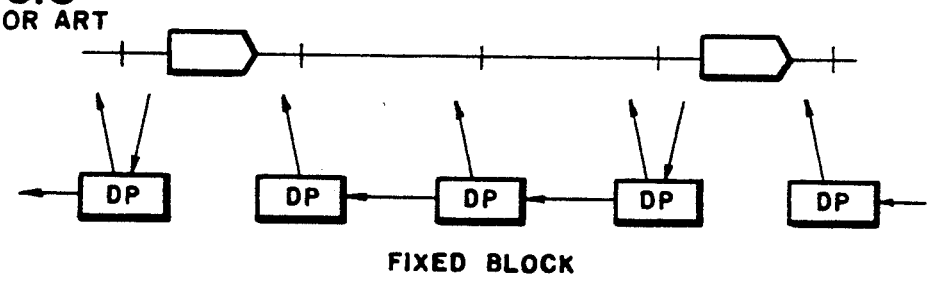
FIG.3 PRIOR ART
FIG. 3 is a schematic representation of a prior art fixed block system.
Figure 4:
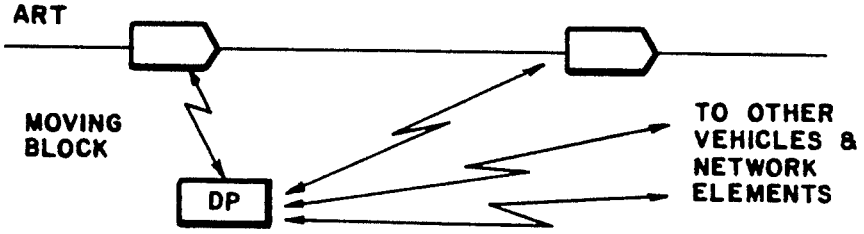
FIG.4 PRIOR ART
FIG. 4 is a schematic representation of a prior art moving block system.

The system and method of the present invention can best be explained by referring to the attached drawings. FIG. 1 shows a simplified yard diagram with two (2) storage tracks and two (2) parking positions per storage track, i.e., track circuits A,B and track circuits C,D, respectively. The diagram shows that vehicles will enter from the left and depart from the right. This is for convenience only and actual operation will be bi-directional to allow system recovery in the event of a component failure. FIG. 2 shows a block diagram of the inputs and outputs to the vital interlocking logic necessary for the system to operate.

In FIG. 1, storage track circuits A, B, C and D are individual track circuits, each slightly longer than a vehicle length. For example, assume that each vehicle is 80 feet long and that each storage track circuit is 90 feet long. A typical storage track circuit is a 60 Hz single rail track circuit separated by insulated joints 10 in one rail only. This allows the other rail to be used as a traction return so that impedance bonds are not necessary at the boundaries of each storage track circuit. By using a phase sensitive relay for the storage track circuit receiver with polarities swapped between circuits, broken down insulated joints can be detected.

Entry/exit track circuits N and X are audio frequency type track circuits of the same type that are used in mainline revenue service. Reference may be made to "High Frequency Track Circuit", General Railway Signal folder 284, November 1984, for an understanding of Wee-z bonds, i.e. low impedance bonds commonly used with this type track circuit.

Since switches SW1, SW2, SW3 and SW4 on each entry/exit track circuit are located very close to one another, the audio frequency track circuits will encompass more than one switch within them. These entry/exit track circuits could also be power frequency type track circuits with cab signals provided to vehicles either through a cab signal loop or a continuous loop.

Cab signal loops A1, A2, B1, B2, C1, C2, D1 and D2 are used for injecting audio frequency cab signals received from their respective transmitters 22 into their respective associated storage track circuits. These cab signals are received by pick-up coils on board the vehicles and are translated into the commands necessary to allow the vehicles to proceed. In addition to the cab signal loops, transmitters N2, X2, and N3, X3 on the audio frequency storage track circuits B, A and D, C respectively also transmit cab signal information.

The Vital Interlocking Logic 20 shown in FIG. 2 performs Boolean operations (ANDs, ORs, and combinations thereof) on the incoming signals in order to provide the required outputs. Along with these vital inputs, a non-vital input (in the form of a serial communication link) from the yard computer is used in the Boolean operations. Vital timing functions are also performed in the Vital Interlocking Logic. This Vital Interlocking Logic is know per se and could take the form of relay logic or electronic logic, such as the General Railway Signal Company's Vital Processing Interlocking TM, which can be appreciated by reference to General Railway Signal folder 295, August 1988.

The yard computer 30 is a non-vital supervisory computer that keeps track of where the vehicles are in the yard and provides the requests to the Interlocking Logic 20 to move the vehicles. The Interlocking Logic takes these non-vital requests and converts them to vital cab signal requests it all the appropriate conditions are met.

The following sequence of events would take place if the yard computer wished to park a vehicle within storage track circuit A. The yard computer 30 would send a request to the Vital Interlocking Logic 20 requesting SW1 to go reverse and for cab signal transmitters N2, B1 and A1 to be turned on. The Interlocking Logic will issue the command to throw SW1 into reverse if entry/exit track circuit N is not occupied and if no cab signal has been turned on to allow a movement to take place over entry/exit track circuit N. When entry/exit track circuit N is occupied, cab signal transmitter N2 is turned on to allow the vehicle to proceed at the yard speed limit. When storage track circuit B is occupied, cab signal loop B1 is turned on to the yard speed limit code rate still allowing the vehicle to proceed. When storage track circuit A is occupied, cab signal loop A1 is turned on to the parking command code rate. This command tells the vehicle to come to a complete stop within storage track circuit A. When loop A1 is energized, the Interlocking Logic prevents any movements from being routed through entry/exit track circuit X (i.e., loop C1 cannot be energized). This allows the profile parking command to be non-vital since overrunning the parking profile into the next block is a safe movement. Cab signal loop A1 is vitally turned off after some pre-determined time (sufficient time for the vehicle to complete its profile stop) or when storage track circuit B becomes unoccupied. This same procedure is followed regardless of the number of vehicles in the consist.

If it is desired to move the entire consist (one or more vehicles) out of the parking area and back into revenue service, then cab signal loop A1 is turned on to the yard speed limit command and the consist proceeds into entry/exit track circuit X, at which time the cab signal transmitter X1 also turns on to the yard speed limit command allowing movement to continue. Cab signal loop A1 would be turned off when X1 is turned on.

If a multiple vehicle consist was parked in storage track 1, but only one vehicle was needed in revenue service, then cab signal loop A1 would be turned on to an "uncouple and proceed" command. The first vehicle would then uncouple its rear coupler and then proceed out in the same manner as a single vehicle. Since only the first vehicle receives cab signal information (due to vehicle shunting), the vehicles in the rear will not move. After the first vehicle has been moved out, the remaining vehicles can be moved forward by energizing cab signal loop A1 to the profile stop cab signal. Since cab signal loop A1 will stop transmitting when storage track circuit B (or the last occupied storage track circuit for longer consists) causing the vehicle to immediately stop, the profile stop command will not move the vehicle beyond storage track circuit A.

The last movement to be considered is forming a multiple vehicle consist from single vehicles. For this example, assume that there are individual vehicles parked in storage track circuits A and B. Cab signal loop B1 would be energized with a "proceed to couple" command which will cause the vehicle parked in storage track circuit B to proceed until it couples with a vehicle in front of it. This command could be a separate command or it could be just a standard yard speed limit command with the "drop out" time on the vehicle extended for that command only This means that the vehicle could continue moving for some pre- determined time (e.g., 10 seconds) after it stopped receiving the yard speed limit command since it has passed into the next storage track circuit. In either case, the trail vehicle will stop moving as soon as it couples to the leading vehicle.

While I have shown and described several embodiments in accordance with my invention, it is to be clearly understood that the same are susceptible to numerous changes and modifications apparent to one skilled in the art. Therefore, I do not wish to be limited to the details shown and described but intend to show all changes and modifications which come within the scope of the appended claims.

I claim:

1. A fixed block system for automatic operation of rapid transit vehicles in a railway yard, each of said vehicles having a receiver means which is responsive to information communicated thereto and control means responsive to said receiver means for controlling the continued operation of said vehicles, said system further including:

a first entry/exit track circuit having at least one transmitting means for transmitting vehicle control information to vehicles within its section of said first entry/exit track circuit, and at least one switching means for reversing said first entry/exit track circuit;

a second entry/exit track circuit having at least one transmitting means for transmitting vehicle control information to vehicles within its section of said second entry/exit track circuit, and at least one switching means for reversing said second entry/exit track circuit;

at least two storage tracks disposed between said first entry/exit track circuit and said second entry/exit track circuit, each storage track having at least two storage track circuits, each of which is slightly longer than a vehicle length, each said storage track circuit having at least one transmitting means for transmitting vehicle control information to vehicles within said storage track circuit; and a computer capable of sending commands to each of said transmitting means to allow said vehicles to operate.

2. The system according to claim 1, further comprising interlocking logic means, said computer being connected to said interlocking logic means; whereby said computer sends non-vital requests to said interlocking logic means which converts said non-vital requests to vital cab signal requests and issues said vital cab signal requests to each of said transmitting means and said switching means.

3. The system according to claim 1, wherein said transmitting means is a cab signal loop.

4. The system according to claim 3, wherein said cab signal loop injects an audio frequency cab signal into its associated track circuit, wherein said cab signal is received by said receiver means on board said vehicle and is translated into commands by said control means to allow said vehicle to operate.

5. The system according to claim 1, wherein said first and second entry/exit track circuits are audio frequency type track circuits.

6. The system according to claim 1, wherein each storage track circuit and entry/exit track circuit include a second transmitting means to allow bi-directional movement of said vehicles.

* * * * *